United States Patent [19]

Yu

[11] Patent Number: 4,502,716

[45] Date of Patent: Mar. 5, 1985

[54] TWO-SHIFT LOCK-TONGUE DRIVE UNIT

[76] Inventor: Tseng-Tsai Yu, 2-6th Fl., 13, Lane 118, Chung Ching S. Rd., Sec. 1, Taipei, Taiwan

[21] Appl. No.: 398,043

[22] Filed: Jul. 14, 1982

[51] Int. Cl.[3] ..... E05C 1/04

[52] U.S. Cl. ..... 292/142; 292/172; 70/134

[58] Field of Search ..... 70/129, 134, DIG. 70; 292/142, 172, 153, 160, 169.15

[56] References Cited

U.S. PATENT DOCUMENTS 4,248,068 2/1981 Esser ..... 292/142

FOREIGN PATENT DOCUMENTS 441484 1/1936 United Kingdom ..... 292/142

*Primary Examiner*—Robert L. Wolfe

[57] ABSTRACT

Disclosed is a lock having a lock tongue with a rearwardly facing elongated rack having teeth and a plurality of notches disposed at intervals along it and a rocking arm having a camming surface and a lug which is sized to be received by the notches in the rack. A rotationally mounted sector gear is provided which has teeth arranged to engage with the teeth of the rack and a cam arranged to engage the camming surface of the rocking arm. The sector gear in one rotational position drives the lock tongue and in another rotational position locks the lock tongue in place by means of the cam and camming surface causing the lug to engage one of the notches.

4 Claims, 11 Drawing Figures

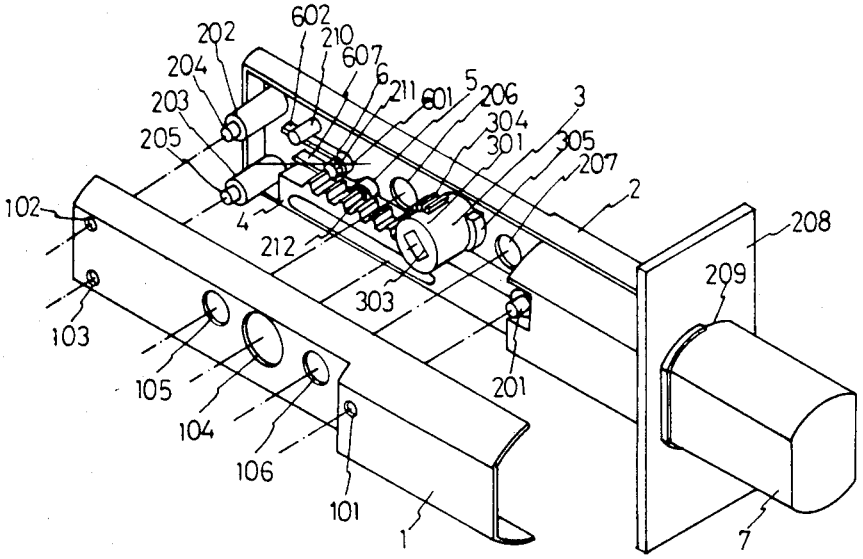
Fig.1
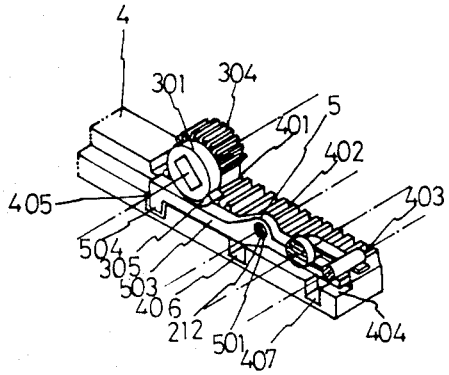
Fig.2
Fig. 3B
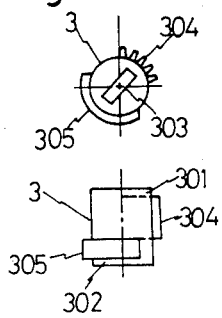
Fig.3A
Fig. 4B
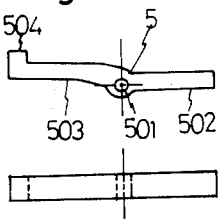
Fig.4A
Fig. 5B
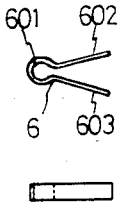
Fig.5A
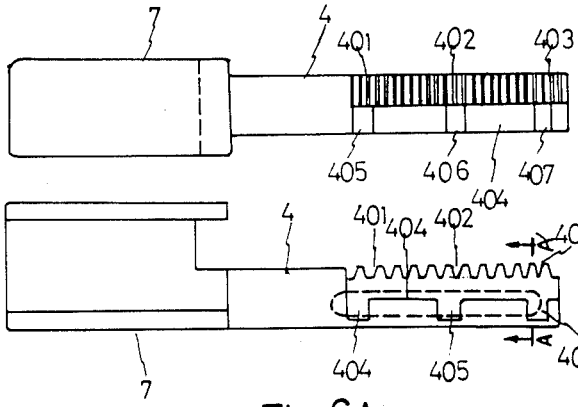
Fig.6A
Fig. 6B
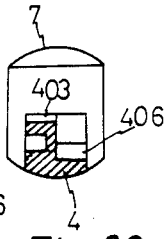
Fig. 6C

TWO-SHIFT LOCK-TONGUE DRIVE UNIT

The invention provides for a construction of the door lock, including the lock-tongue and the driving unit therefor for installation in the door frame for the purpose of limiting the door to open or to closure, exclusive of the grip and the key of the lock concerned.

Traditionally, the lock-tongue of a conventional door lock undergoes but one single movement when it moves out of or moves back into the locker, the length protracted is therefore restricted, a consequence frequently experienced is that the door slot to leave out can vary due to specific specification requirements of the door or to the workmanship of the door maker, to the effect that improper lock-up probability involving a lock tongue in action is increased substantially, and that even a precision lock would fail to serve to secure an accurate door closure where the door slot standing in-between is not fully compensated for.

The member used to displace the lock tongue in most locks is a cam which suffers restrictions in volume and directivity in the lock body, in some cases, the cam may even get exposed from the lock body, length exposed being proportional to the length of the lock-tongue projected out, the result is that the hole to be drilled on the door will have to be enlarged accordingly, and that is a major shortcoming in the design or such locks.

The lock-tongue drive unit as covered by the present invention is provided to have an indented piece provided as the tail of the lock tongue driven by a sector gear in conjunction with the composite axis of the cam mentioned earlier to the effect that the cam will exert pressure on the rocking arm thereof the moment when the sector gear moves beyond prescribed limits thanks to the interactive checks existing between the sector gear and the cam, whereupon the fore-section of the rocking arm will get caught into the slide chute by the side of the indented piece to check the lock tongue from further movements whatever so that the indented piece will be in a position for transmission by said composite axis to react in lateral displacements whilst the foresection of the rocking arm begins to assume a sequence control of the three notches on the slide way at the same time to achieve in a two-shift drive of the lock tongue.

Structurally the present invention attains the position-security feature of the lock by a two-shift contraction of the lock tongue by virtue of the joint efforts participated by an axis in combination with indented pieces and slide way components, rocking arms to remove troubles incurred due to irregularities at door seam, door slot locations characteristic in simpleness of the structure of components and parts used therein to facilitate production to cut down production costs whilst serving to reduce amply failure rates if any.

To describe the invention in further details reference will be made to the enclosed drawings in which:

FIG. 1 is a three-dimensional perspective of the present invention accomplished of assemblage excepting the overall casing;

FIG. 2 is a view as seen from the back of the casing of the present invention titled Two-shift lock-tongue drive unit, back cover being dismantled, latter section of the lock tongue being taken, axel and the lock pin intercepted across the inner rim of the back cover;

FIGS. 3A and 3B are bottom and side views of the axel;

FIGS. 4A and 4B are top and elevation views of the rocking arm;

FIGS. 5A and 5B are top and elevation views of the spring clip;

FIGS. 6A and 6B are elevation and top views of the lock tongue; and

FIG. 6C is a section view taken along A—A of FIG. 6A.

DETAILED DESCRIPTION OF A PREFERRED EMBODIMENT

Referring to FIG. 1 it is seen that the front casing 1 and the rear casing 2 are supplementary to each other, rivet 201 being riveted into hole 101 rivets 204, 205 in sleeve-molds 202, 203 secured through holes 102, 103 to hold front casing 1 and rear casing 2 together.

To follow that, axial hole 104 is sleeved around axel 3, screw hole 105 set concentric with screw hole 206, and screw hole 106 is aligned concentrically with screw hole 207 to facilitate passing of the fix screws through each hole coupling. A lock tongue hole 209 is provided on surface 208 to give access to the projection of the lock tongue.

On the inner face of the rear casing 2 there is provided a lug 210, a pin 211 complete with a spring clip 6 one end of which 602 being checked by lug 210, the other end 603 serving to exert pressure against the arm tail 502 of the rocking arm 5.

The shape of axel 3 is as demonstrated in FIGS. 3A and 3B. It is located above the rack or indented piece 4 in the casing, projecting into axial hole by two end rims 301, 302 and, passing by the key to rest into the central square hole 303. Rotation-shaft axel by means of sector gear 304 drives the indented piece. Once the sector gear 304 is rotated to a point beyond the last tooth of the indented piece, cam 305 will be in a position to press against rocking arm 5, as the rotation goes on to pass beyond the end rim of the cam 305, sector gear 304 will forthwith come into contact with the teeth on the indented piece 4 to continue transmission of the indented piece 4 thereby giving drive to lock tongue 7.

FIG. 2 demonstrates that as the indented piece 4 is transmitted by the sector gear 304, there will follow up an idle running at position 401 whilst in the meanwhile cam 305 moves down to impose pressure upon the rocking arm 5 which swings about pin 212 with respect to the center hole 501, but is subjected to be checked by a spring clip at the tail 502 of the arm. The idea is that as the forearm 503 is being checked by cam 305, lug 504 on the rocking arm will be in a position to get caught in the first groove 405 of the slide way 404. Referring again to the drawings and it is readily understandable that as axel 3 is rotating to the right to cause release of the rocking arm by cam 305, the indented piece 4 will be transmitted to turn left by the reaction of the sector gear 304, and as the indented piece 402 moves on to a position straight down the axel 3, sector gear 304 will start idle running, whereupon cam 305 will once again act to depress the forearm 503 of the rocking arm. Thereafter, the lug 504 of the rocking arm 5 will get caught into the slide groove 406 whereas when cam 305 turns to a position to have the rocking arm 5 released, the tail of the rocking arm 5, being suppressed by the spring clip 6, will serve to lift up the lug 504 of the rocking arm 5 to a point that is higher than top of the groove 405 to relieve contacting with slide way 404 thus making possible a smooth displacement. The procedure when repeated all over again, for full advancement or regression of the lock tongue 7. With the particular directivity of a matching key it is possible to withdraw a set-in key only if the lock tongue is firmly checked by the rocking arm from motion.

Observing the axel 3 as depicted in FIG. 3B it will be noted that at the axially symmetrical contrapositions of the central square hole 303 there are provided a sector gear 304 and a cam 305 as twin composite units, for which the rotation center is served by the center of the axis.

Underneath the axial edge 301, as viewed in FIG. 3A, there lies the sector gear 304 whose lower edge line serves or coincides with the upper edge of cam 305, the lower edge of the cam 305 is collateral with the axial edge 302.

A review of FIGS. 4A and 4B will give that with respect to the hole of the center of rotation 501 for the rocking arm 5 there exists a distance differential out of measurement to the right arm tail 502 as opposed to measurement made to the forearm 503, the front end of the forearm 503 is bent to present an upgoing flange 504 with no extra breadth increase.

Referring to FIGS. 6A–6C it is seen that the rear end of the lock tongue 7 is processed as an indented piece 4 half of which is executed as a tooth edge, the other half executed as a slide way 404 on the lower side. To set up, proceed to assemble rocking arm 5, spring clip 6 into the rear casing 2, thence fill in the lock tongue 7 and the indented piece 4, and finally axis 3 is set in to finish by sealing up both front casing 1 and the rear casing 2 thus accomplishing the assemblage of the lock tongue as illustrated in FIG. 1, it is believed that such an execution in designing a door lock is just what most lock designers pursuit after, embodying practicality, production desirability and ecnomical benefits into realization.

What is claimed is:

1. A lock comprising:

a lock tongue having a rearwardly facing elongated rack with teeth and a plurality of notches disposed at intervals along said rack;

a rocking arm having a camming surface and a lug which is sized to be received by said notches in said rack;

a rotationally mounted sector gear having teeth arranged to engage with the teeth of said rack and having a cam arranged to engage the camming surface of said rocking arm and to thereby move said lug of said rocking arm into one of said notches, said sector gear in one rotational position thereof driving said lock tongue and in another rotational position thereof locking said lock tongue in place by means of said cam and camming surface causing said lug to engage one of said notches.

2. The lock according to claim 1, wherein said teeth of said sector gear subtend an angle less than 180° and wherein said cam is radially disposed and subtends an angle of less than 180°, the angle subtended by said cam being diametrically opposed to the angle subtended by the teeth with respect to the axis of rotation of said sector gear.

3. The lock of claim 2, wherein said rack has three of said notches and wherein two complete rotations of said sector gear move said lock tongue between locked and unlocked positions thereof, said lug of said rocking arm engaging each one of said notches during the two rotations of said sector gear.

4. The lock according to claim 3, further including a housing for supporting said lock tongue, rocking arm and sector gear, and further including a spring mounted on said housing for urging the lug of said rocking arm away from said notches.

* * * * *